US010315903B2

(12) United States Patent
Zardini

(10) Patent No.: US 10,315,903 B2
(45) Date of Patent: Jun. 11, 2019

(54) DEVICE FOR OPENING CONTAINERS FOR LIQUIDS AND FOR HOLDING THE CORRESPONDING LIDS

(71) Applicant: STEELCO SPA, Riese Pio X (IT)

(72) Inventor: Fabio Zardini, Castelfranco Veneto (IT)

(73) Assignee: STEELCO S.P.A., Riese Pio X (IT)

( * ) Notice: Subject to any disclaimer, the term of this patent is extended or adjusted under 35 U.S.C. 154(b) by 922 days.

(21) Appl. No.: 14/406,188

(22) PCT Filed: Jun. 6, 2013

(86) PCT No.: PCT/IB2013/001192
§ 371 (c)(1),
(2) Date: Dec. 5, 2014

(87) PCT Pub. No.: WO2013/182891
PCT Pub. Date: Dec. 12, 2013

(65) Prior Publication Data

US 2015/0166318 A1 Jun. 18, 2015

(30) Foreign Application Priority Data

Jun. 7, 2012 (IT) ..... UD2012A0107

(51) Int. Cl.
*B67B 7/18* (2006.01)
*B67B 7/00* (2006.01)
(Continued)

(52) U.S. Cl.
CPC ..... *B67B 7/182* (2013.01); *B67B 3/24* (2013.01); *B67B 7/00* (2013.01); *B67B 7/14* (2013.01); *B67B 7/20* (2013.01)

(58) Field of Classification Search
CPC ..... B67B 7/182; B67B 7/0033; B67B 7/00; B67B 7/2821; B67B 3/24; B08B 3/02; B08B 9/28
(Continued)

(56) References Cited

U.S. PATENT DOCUMENTS 3,686,824 A * 8/1972 Rink ..... B67B 7/164 53/381.4
6,475,435 B1 * 11/2002 Taggart ..... B67C 7/0033 422/28
(Continued)

FOREIGN PATENT DOCUMENTS

DE 3401836 A1 8/1985
EP 2 460 593 A1 6/2012
(Continued)

OTHER PUBLICATIONS

Search Report for PCT/IB2013/001192, dated Oct. 24, 2013.
Written Opinion for PCT/IB2013/001192, dated Oct. 24, 2013.

*Primary Examiner* — Andrew M Tecco
*Assistant Examiner* — Mary Hibbert
(74) *Attorney, Agent, or Firm* — Marshall, Gerstein & Borun LLP

(57) ABSTRACT

A device for opening, or re-closing, and holding lids of containers, each provided with an oblong spout, comprises a removal head of the pneumatic type which has a through housing channel which develops along an axis and in which the spout is at least partly housed, and a holding member, associated to the removal head, to cooperate with the spout. The holding member is actuated pneumatically to define at least a reversible condition of holding the spout inside the housing channel and comprises elastically deformable means which laterally delimit the housing channel. The elastically deformable means are configured to be deformed elastically by means of a fluid under pressure, so as to
(Continued)

selectively define a reduction in section of the housing channel suitable to hold the spout.

20 Claims, 2 Drawing Sheets

(51) Int. Cl.
*B67B 7/14* (2006.01)
*B67B 7/20* (2006.01)
*B67B 3/24* (2006.01)

(58) Field of Classification Search
USPC ..... 53/329, 167, 281, 287, 317, 484
See application file for complete search history.

(56) References Cited

U.S. PATENT DOCUMENTS

| | | | | |
|---|---|---|---|---|
| 7,387,049 | B1 * | 6/2008 | Ver Hage | A01K 7/00 53/490 |
| 2006/0185601 | A1 * | 8/2006 | Correa | A01K 45/007 119/6.8 |
| 2012/0198969 | A1 * | 8/2012 | Casonato | B67B 7/00 81/3.2 |

FOREIGN PATENT DOCUMENTS

| | | | | |
|---|---|---|---|---|
| EP | 2460593 | A1 * | 6/2012 | B08B 9/20 |
| WO | WO-2011/045256 | A1 | 4/2011 | |
| WO | WO-2011/138661 | A1 | 11/2011 | |
| WO | WO-2011/158085 | A1 | 12/2011 | |

* cited by examiner

DEVICE FOR OPENING CONTAINERS FOR LIQUIDS AND FOR HOLDING THE CORRESPONDING LIDS

FIELD OF THE INVENTION

The present invention concerns a device able to open or unstop containers for liquids, for example, but not exclusively, bottles, feeding bottles, drinking troughs or other containers or receptacles for feeding animals, and to hold the lids of said containers, in order to send them to subsequent treatments and, at the end of the washing and filling operations, to re-close them.

BACKGROUND OF THE INVENTION

Machines are known, at least partly automated or manual, used for washing containers for liquids, for example, but not only, for bottles, feeding bottles, drinking troughs or others, used for feeding, by means of spouts made on the closing lids, of animals such as for example laboratory guinea pigs or rodents or others. The containers and the corresponding spouts can be of different sizes and volumes, in order to adapt to the different sizes and needs of the animals to be fed. In particular, the diameter of the spouts normally available on the market varies inside a range between a minimum value, suitable for small animals, and a maximum value, for bigger animals.

Such washing machines are generally structured with several operating stations disposed in succession with respect to each other, including a loading station for the closed containers, a removal station to remove the lids from the containers, or de-lidding station, a washing station, a filling station and a closing station, of the washed and re-filled containers, in which the lids, washed in their turn, are repositioned on the containers.

The lids are normally constrained by a water-tight seal to the containers, therefore, in known solutions which provide the removal station, the closed containers are opened by removing the lids using suitable opening devices.

These known devices are provided with mechanical holding members of the lids, once they have been removed from the containers, driven mechanically and with the function of generating a friction force on the spouts of the lids, both to prevent these falling due to gravity after opening, and also to allow handling during working.

Known mechanical holding members however are limited because they are not effectively adaptable to the different sizes of the spouts and are therefore not very versatile and not completely reliable above all in holding spouts with smaller diameters. This is even more disadvantageous with an increased variability of the diameters of the spouts treated in a single washing machine.

An example of an opening device is described in the international patent application WO-A-2001/045256 in the name of the present Applicant, in which a pneumatic action is exploited, induced to separate the lid from the container and in which such devices are provided with mechanical holding devices of the pliers type, which actuate a radial gripping action on the lid in order to hold it in the steps of extracting or separating and transporting the lid.

However, even if they are effective in guaranteeing a correct holding of the lid during said steps, these mechanical holding members need specific actuator mechanisms, both to define the holding and also the release of the lid.

Actuating these actuator mechanisms either to grip or release requires specific commands and controls, with corresponding times and costs of programming and coordination with the other units and working stations.

As well as having their own programming and manufacturing costs, these commands can have malfunctions that can cause slowing down or operating interruptions, and also require periodic maintenance and control interventions.

A device is also known and described in the international patent WO-A-2001/158085 in the name of the present Applicant, for opening containers and for holding corresponding lids which uses an elastic member, deformable by means of mechanical elements, such as pins or pegs, in order to keep clamping and holding elements radially thrust against the spout of the lid.

This known device also comprises one or more extractor elements which, located inside the air passage pipes of the corresponding removal members, exert an axial thrusting action on the spout of the lid, overcoming the elastic action exerted by the holding means, so as to bring it outside the air passage pipe.

Even though this device allows to limit the times for opening the containers and to carry out this operation simply, it is not completely reliable because of the possible variability of the diameters of the spouts, in particular for spouts with smaller diameters, in cases where there is a wide variability of the diameters of the spouts. Indeed, since the holding members are the mechanical type and are generally calibrated on larger diameters, they are not normally suitable to effect a grip or apply a force that is reliable and sufficient to hold the spouts of smaller diameters.

A further disadvantage derives from the fact that the thrust force exerted by the extractor elements on the spouts, if not suitably controlled, can cause the latter to be deformed or damaged and can render them useless.

A device to hold lids of containers is also known from the international patent application WO-A-2011/138661 in the name of the present Applicant. This known device comprises a holding member provided with a mechanical clamping member selectively activated to grip the spout of a corresponding lid.

Furthermore, application DE-A-3401386 describes a closing head to screw a screw top to a threaded opening of a bottle. The device described in DE-A-3401386 is not suitable to open and also hold the lids removed from the container, in particular it is not suitable for containers with lid with a spout as discussed here. This known device comprises a single circuit for a fluid under pressure by means of which to deform an elastic diaphragm member fitted on the screw top. In this way, the diaphragm elastic member grips on the top, and the closing head, by means of rotation, can screw the screw top.

It is therefore a purpose of the present invention to obtain a device for opening containers and holding the corresponding lids that is effective and reliable in the holding of the lids, irrespective of the variability of diameters of the spouts of the lids to be treated.

It is also a purpose of the present invention to obtain a device that allows to open the containers simply, economically and efficiently, that allows to reduce the overall execution times to a minimum, without damaging the spouts of the lids.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a device according to the present invention is usable for opening, re-closing and holding lids of containers, each provided with an oblong spout that has a through hole for the passage of the product present in the container. The device of the present invention comprises a removal head of the pneumatic type that comprises:

- a first pneumatic circuit of fluid under pressure provided with a feed pipe and a through housing channel which develops along an axis and in which the spout is at least partly housed, wherein the housing channel is in fluidic communication with the feed pipe for the passage of the fluid under pressure through the through hole of the spout;
- a holding member, associated to the removal head, to cooperate with the spout, in particular holding the latter when the lid is removed from the container. The lid can thus be held suspended to the removal head.

According to one form of embodiment of the present invention, the device in question comprises a second pneumatic circuit of fluid under pressure provided with a blowing-in pipe, different from the feed pipe of the first pneumatic circuit of fluid under pressure. Moreover, the holding member is actuated pneumatically by means of the fluid under pressure arriving from the blowing-in pipe of the second pneumatic circuit of fluid under pressure, to define at least a reversible condition of holding the spout inside the housing channel. The holding member also comprises elastically deformable means which laterally delimit the housing channel, the elastically deformable means being configured to be deformed elastically by means of the fluid under pressure, so as to selectively define a reduction in section of the housing channel, suitable to hold the spout.

Since the device uses elastically deformable means with pneumatic drive in order to hold the spouts and the lids, it is advantageously adaptable to any diameter of spout, even the smallest ones, given that the entity of the deformation of the elastically deformable means substantially depends on the pressure of the drive fluid. The choice of a material with high deformability allows to cover a much wider range of diameters of spouts with respect to the state of the art, with great reliability and stable holding, even for reduced diameters, compared to what is possible with the mechanically driven holding devices of the known type.

The use of a pneumatic drive also allows to simplify the manufacturing of the device, with consequent economical and technical advantages, linked to the greater cleanliness and ease of maintenance compared to mechanically driven components.

According to one form of embodiment, the elastically deformable means are shaped with an axial-symmetric development, centrally delimiting the housing channel and are configured to deform radially with respect to the axis toward the inside of the housing channel.

According to one form of embodiment, the removal head comprises at the lower part a centering sleeve, coaxial to the axis of the housing channel and shaped to define a lead-in zone, for the correct centered insertion of the spout inside the housing channel. In a variant the lead-in zone ends with a through hole which faces toward the housing channel.

In one form of embodiment, the centering sleeve is shaped so as to also define a housing seating, in which to place the elastically deformable means.

According to one form of embodiment, the removal head comprises a closing sleeve, positioned at least partly inside the housing seating of the centering sleeve, in order to clamp the elastically deformable means and to define a compression chamber closed with a fluid-tight seal, inside the housing seating, in selective fluidic communication with the second circuit which supplies fluid under pressure by means of a connector.

According to some forms of embodiment, the connector is provided with a blowing-in channel, which puts the compression chamber in communication with the blowing-in pipe, by means of which the fluid under pressure is blown inside the compression chamber.

According to some forms of embodiment, the elastically deformable means comprise an inflatable packing having an annular shape, to define internally the housing channel.

In possible implementations, the inflatable packing has a first end which rests on the bottom of the housing seating and cooperates at the lower part with the closing sleeve, a second end which cooperates at the upper part with the closing sleeve and a tubular element which connects the first end and the second end, delimiting the housing channel.

According to some forms of embodiment, the elastically deformable means comprise a tubular element which laterally delimits the housing channel, at least along part of its axial development.

In possible implementations, the closing sleeve has a tubular shell which projects inside the housing seating, externally fitted to the tubular element and having at least an eyelet, which puts the compression chamber in communication with the tubular element.

BRIEF DESCRIPTION OF THE DRAWINGS

These and other characteristics of the present invention will become apparent from the following description of some forms of embodiment, given as a non-restrictive example with reference to the attached drawings wherein.

To facilitate comprehension, the same reference numbers have been used, where possible, to identify identical common elements in the drawings.

DETAILED DESCRIPTION OF SOME FORMS OF EMBODIMENT

Figure 2:
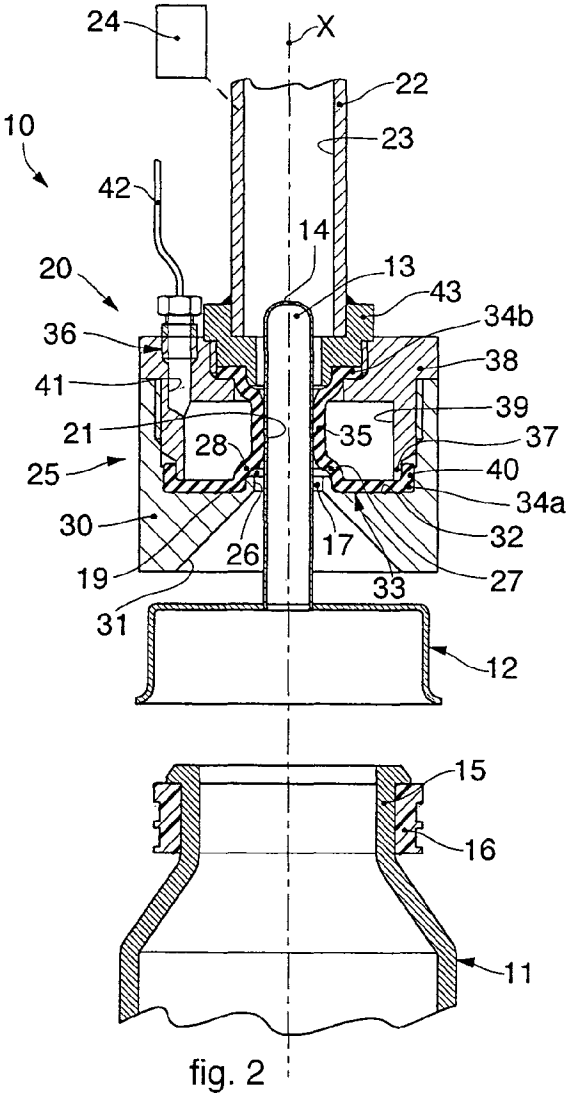
FIG. 2 is a section view of the device of FIG. 1 in a second holding condition.

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

With reference to the attached drawings a device 10 according to the present invention is usable for removing/opening, or for re-closing, and the simultaneous holding of lids 12 of containers 11 usually used for feeding, by means of a liquid or comparable substance contained therein, small animals such as guinea pigs, mice or other, for example used in pharmaceutical research laboratories. The device 10 is used in particular in treatment machines, that is pre-washing, washing, drying and refilling of the containers 11.

Each container 11 is normally closed at the top by a metal lid 12, shaped to define an oblong spout 13 protruding toward the outside, generally of a cylindrical tubular shape, provided at its free end with a through hole 14 from which the animal drinks the liquid contained in the container 11.

In particular, each container 11 has a closing neck 15, on which the lid 12 is positioned. A packing 16 is annularly and externally disposed on the closing neck 15 and, in cooperation with the lid 12, determines the hermetic seal of the container 11 in correspondence to the closing neck 15.

The device 10 comprises a removal head 20 of the pneumatic type, in this case, for example with a substantially cylindrical shape, hollow inside, which comprises a first pneumatic circuit of fluid under pressure provided with a feed pipe 22. The first pneumatic circuit of fluid also defines a through housing channel 21 in which the spout 13 is suitable to be at least partly housed.

The removal head 20 is connected at the top to a source of fluid under pressure (not shown) by means of the feed pipe 22 of the first pneumatic circuit of fluid under pressure, which defines, for example, a feed channel 23, communicating with the housing channel 21. The latter therefore puts the inside of the container 11 into fluidic communication with the source of the fluid under pressure. In particular the housing channel 21 is in fluidic communication with the feed pipe 22 for the passage of the fluid under pressure through the through hole 14 of the spout 13.

Moreover, the device 10 comprises a holding member 25 actuated pneumatically to cooperate with the spout 13.

Furthermore, the device 10 comprises a second pneumatic circuit of fluid under pressure which is autonomous and separate from the first pneumatic circuit of fluid under pressure. In particular, the second pneumatic circuit of fluid under pressure is provided with a blowing-in pipe 42, different from the feed pipe 22 of the first pneumatic circuit of fluid under pressure.

In some forms of embodiment, the holding member 25 is actuated pneumatically by means of the fluid under pressure arriving from the blowing-in pipe 42 of the second pneumatic circuit of fluid under pressure, to define at least a reversible condition of holding the spout 13 inside the housing channel 21.

Figure 1:
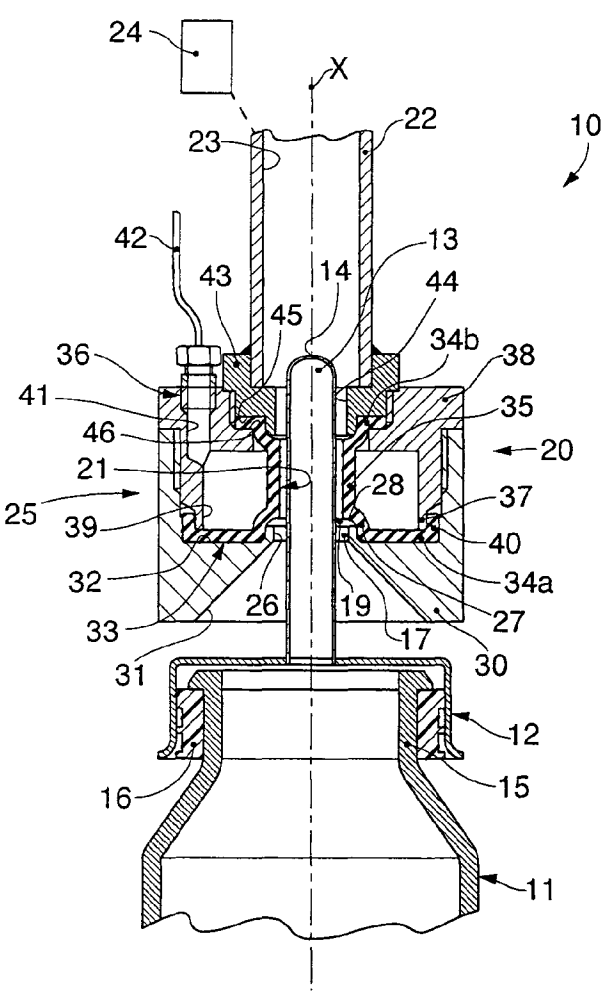
FIG. 1 is a section view of a device according to the invention in a first coupled condition.

In this way, for the purpose of opening, the fluid under pressure arriving from the source as described above flows through the removal head 20 toward the spout 13 and enters into the container 11 through the through hole 14, achieving the first coupled condition (FIG. 1). The pressure inside the container 11 causes a thrust reaction which brings about the removal and complete detachment of the lid 12 from the container 11. At this point, or at the same time according to the possible variant forms of embodiment, the holding member 25 is pneumatically actuated to hold the spout 13, separate from the container 11, coupled to the removal head 20, achieving the second holding condition. The second holding condition can be subsequently released to send the spout 13 on to subsequent washing and drying treatments. Instead, in order to re-close the container 11, the same device 10, or an identical one, can be used to remove the spout 13, once washed and dried, and holding it, can position it stably coupled to the containers 11 which, in their turn, have been washed, dried and once again filled.

By providing a first pneumatic circuit of fluid under pressure for opening and a second pneumatic circuit of fluid under pressure for holding, autonomous and separate from the first circuit, and therefore usable independently from this, the present invention can carry out the operations of opening, holding, re-closing and release with considerable speed of execution.

In some forms of embodiment, during the opening and re-closing steps, the device 10 is vertically mobile, along an axis of translation X, by means of an actuator 24, schematically shown in the attached drawings, between at least a raised position and a lowered position in which it cooperates with the spout 13.

Moreover, in some other forms of embodiment, the device 10 can be positioned in correspondence with different operating stations or islands of the washing machine.

According to some forms of embodiment, the holding member 25 comprises elastically deformable means 33, 133 which laterally delimit the housing channel 21, for example at least for a determinate length along the axis X.

The elastically deformable means 33, 133 are configured to be deformed by means of the fluid under pressure arriving from the blowing-in pipe 42 of the second pneumatic circuit of fluid under pressure, so as to cooperate selectively during holding with the spout 13 inserted inside them in the housing channel 21 and to define the reversible passage from the first coupled condition (FIG. 1) to the second holding condition (FIG. 2). In particular the elastically deformable means 33, 133 are configured to deform radially with respect to the axis of translation X, reducing the section of the housing channel 21, so as to go into contact and interfere with the spout 13, holding it with a radial holding force determined in substance by the pressure of the fluid.

In this case, the elastically deformable means 33, 133 can for example be shaped with an axial-symmetric development and delimit a central passage channel which defines the housing channel 21.

In some forms of embodiment, the removal head 20 comprises at the lower part a centering sleeve 30, externally cylindrical and hollow inside, positioned in the part of the removal head 20 nearest to the lid 12 in the operating steps.

The centering sleeve 30 is coaxial to the axis of translation X and is shaped to define a lead-in zone 31, in this case conical which, facing toward the spout 13 during use, allows, as the removal head 20 approaches the lid 12, the correct centered insertion of the spout 13 inside the housing channel 21, in a substantially coaxial manner to the axis of translation X. The lead-in zone 31 ends with a through hole 26 which, as will be described more fully hereafter, faces toward the housing channel 21. The spout 13 is thus axially guided toward the center of the lead-in zone 31, in order to then be inserted in the through hole 26 and, from here, inside the housing channel 21, where it can interact with the holding member 25, in particular with the elastically deformable means 33, 133.

The centering sleeve 30 is also shaped so as to define a housing seating 32, in an opposite position to the lead-in zone 31 and separated therefrom by a wall through which the through hole 26 is made. A positioning ring 17 can be coupled to the through hole 26, having a support flange 19 on the external annular edge which delimits the through hole 26, on the bottom of the housing seating 32.

The elastically deformable means 33, 133 are positioned in the housing seating 32, so that the housing channel 21 defined by them is aligned to the through hole 26.

In some forms of embodiment, a closing sleeve 38 is positioned at least partly inside the housing seating 32 of the centering sleeve 30, acting as an upper closing, to clamp the elastically deformable means 33, 133. The closing sleeve 38 also cooperates with the elastically deformable means 33, 133 to define with them a compression chamber 39 closed with a fluid-tight seal, inside the housing seating 32.

The compression chamber 39 is in selective fluidic communication with a circuit, preferably different from the circuit associated to the source of fluid under pressure used for the opening. This circuit supplies fluid, such as air under pressure, introduced into the compression chamber 39 by means of a connector 36, in this case associated to the closing sleeve 38, as will be explained hereafter.

The elastically deformable means 33, 133 are thus comprised and positioned stably between the centering sleeve 30 and the closing sleeve 38 and can be deformed in a reversible way inside the compression chamber 39.

In the variant shown in FIGS. 1 and 2, the elastically deformable means comprise an inflatable packing 33 made of a deformable polymer material, such as rubber or silicone and which acts as a deformable elastic element. The inflatable packing 33 has an annular shape, to centrally define the housing channel 21, and a substantially C-shaped cross section.

The inflatable packing 33 has a first end 34*a* which rests on the bottom of the housing seating 32, in this case disc-shaped and which has a peripheral rib 40.

Moreover, the inflatable packing 33 has a second end 34*b*, in this case substantially shaped like an upended cup. The first end 34*a* and the second end 34*b* are connected by a tube, or comparable tubular element 35, which defines the internal diameter of the same annular shape and therefore of the housing channel 21.

Advantageously, the internal diameter is slightly bigger than the maximum diameter possible of the spouts 13 to be treated and which are normally on the market, so that it is possible, when inactive in the non-deformed condition, to accommodate inside it the variability of spouts 13 available on the market.

In particular, the inflatable packing 33 is disposed coaxial to the axis of translation X, so that the tube 35 laterally surrounds the spout 13, at least for part of the length along the axis X, when the removal head 20 is in a suitable position to open or close the container 11. Advantageously, the inflatable packing 33 is sized so as to define the lateral wall at least of the central part of the housing channel 21, sufficient to cooperate with a determinate portion of the lateral surface of the spout 13 so as to allow an efficient holding.

In particular, in the variant in FIGS. 1 and 2, at least the tube 35 of the inflatable packing 33 is elastically deformed in a radial direction so as to contact the spout 13, in the second holding condition.

In some forms of embodiment, the end part of the tube 35 which connects to the first end 34*a* can have a shoulder or step 27 which rests in abutment on a beveled edge 28 of the flange 19 of the positioning ring 17. This solution increases the fluid-tight seal and mechanical resistance of the inflatable packing 33.

Moreover, to promote the fluid-tight seal of the compression chamber 39, the peripheral rib 40 of the inflatable packing 33 cooperates with the lower annular edge 37 of the closing sleeve 38 which rests head-wise on the first end 34*a*. Moreover, the lower annular edge 37 is radially positioned more inside the peripheral rib 40, going into contact laterally with the latter, preventing the fluid under pressure from leaking.

In some forms of embodiment, the removal head 20 also comprises a guide bushing 43, interposed between the feed pipe 22 and the closing sleeve 38 and connected to both. The guide bushing 43 has, for example, a substantially cylindrical shape, having internally a through cavity 44, and is positioned at least partly inside the closing sleeve 38 and coaxial to the axis of translation X. In this way, the through cavity 44 of the guide bushing 43 can define the upper part of the housing channel 21 in communication with the feed channel 23 and can also act as a guide for the alignment of the spout 13 along the axis of translation X during the positioning step of the spout 13.

Moreover, the guide bushing 43 comprises an external shoulder 45 which cooperates with a mating internal shoulder 46 of the closing sleeve 38 to constrain the second end 34*b* of the inflatable packing 33, opposite the first end 34*a*. In this way, the only part of the inflatable packing 33 that can deform radially is substantially the tube 35.

The connector 36, associated in the case shown here by way of example to the closing sleeve 38, is provided with a blowing-in channel 41, different from the feed pipe 22, in this case made through the upper wall of the closing sleeve 38, which puts the compression chamber 39 into communication with the blowing-in pipe 42, by means of which the fluid, such as air, is blown under pressure inside the compression chamber 39.

In particular, the separation of the feed 22 and blowing-in 42 pipes allows the present invention a considerable speed in the opening, holding, re-closing and release operations, because it also allows a nearly contemporaneous use of the two feed 22 and blowing-in 42 pipes, reducing the execution times of these operations to a minimum.

This blowing-in allows to bring the compression chamber 39 under pressure, in order to deform the inflatable packing 33 and radially thrust the tube 35 into contact with the spout 13 of the lid 12. Therefore, the blowing-in channel 41, the blowing-in pipe 42 and the compression chamber 39 act as pneumatic drive means for the inflatable packing 33.

The coupling of the inflatable packing 33 and the spout 13 determines the passage of the device 10 from the first coupled condition (FIG. 1) to the second holding condition (FIG. 2). Indeed, as long as the compression chamber 39 is kept under pressure, the inflatable packing 33 exerts a radial holding force on the spout 13, in order to hold it during the subsequent operating and movement steps.

When the device 10 is in the second holding condition, the housing channel 21 has a fluid-tight seal because of the effect of the contact between the tube 35 of the inflatable packing 33 and the spout 13, and the opening operation is therefore possible. Only in this operating condition does all the air coming from the gas source enter inside the container 11 through the through hole 14 of the spout 13, and does not exit elsewhere.

Moreover, in the second holding condition, the lid 12 can be transported by the device 10, after the containers 11 have been opened, to stations where the lid 12 is treated, or from these stations to the station where the containers 11 are closed.

The lid 12 is freed from the device 10 by releasing pressure inside the compression chamber 39, which causes the return of the inflatable packing 33 to an inactive position, non-deformed, in which the tube 35 is no longer in contact with the spout 13.

Figure 4:
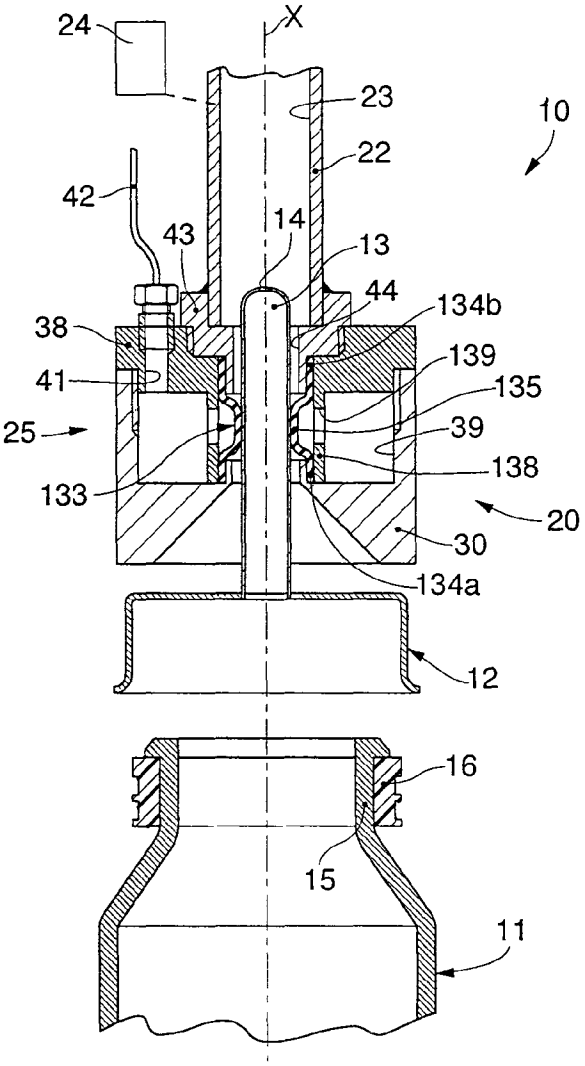
FIG. 4 shows the device of FIG. 3 in a second holding condition.
Figure 3:
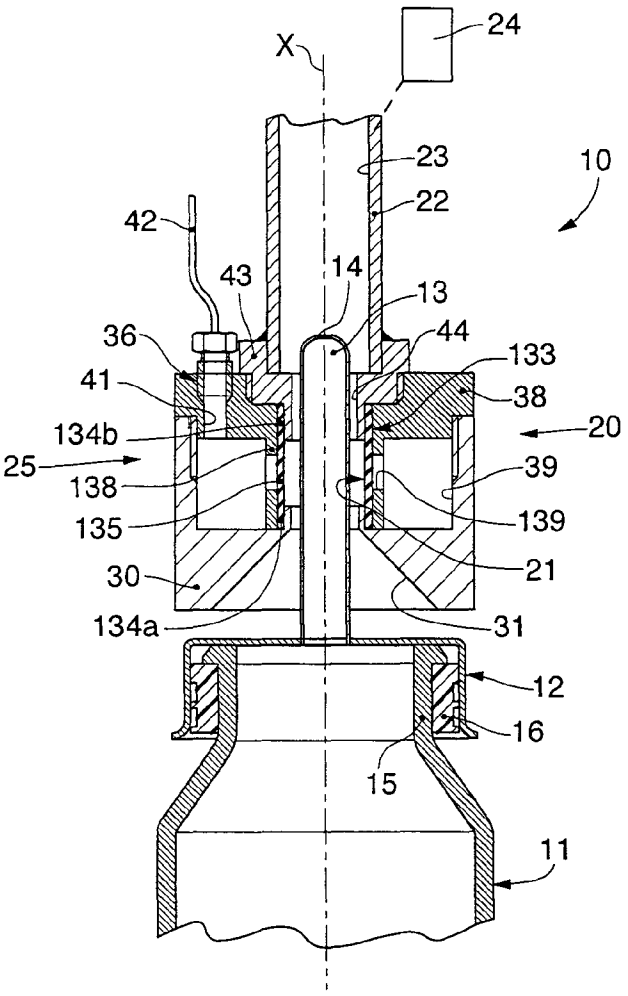
FIG. 3 is a variant of FIG. 1.

In another variant of the device 10 (FIGS. 3 and 4), the elastically deformable means comprise a tube, or similar tubular element 133, made of polymer material, elastic and deformable, similar to the inflatable packing 33. The tube 133 is positioned coaxial to the axis of translation X and laterally delimits the housing channel 21 at least along part of its axial development, with an internal diameter bigger than the diameters of the spouts 13 to be treated.

The centering sleeve 30 and the closing sleeve 38 cooperate to constrain a first end 134*a* of the tube 133, while the closing sleeve 38 and the guide bushing 43 cooperate to constrain the second end 134*b*, opposite the first end 134*a*.

In this variant, the closing sleeve 38 has a tubular shell 138 that projects out inside the housing seating 32, abutting on the bottom thereof. The tubular shell 138 is fitted externally to the tube 133, surrounding it. The tubular shell 138 has at least an eyelet, or similar through aperture 139, which puts the compression chamber 39 into communication with the tube 133 so that the compressed fluid can act directly on the latter and deform it (FIG. 4), in order to reduce the section of the housing channel 21.

In particular, thanks to the eyelet 139 it is possible to direct the fluid under pressure arriving from the blowing-in channel 41 toward a central zone 135 of the tube 133, which is deformed going into contact with the spout 13. Since the ends 134*a*, 134*b* of the tube 133 are constrained, as described above, the central zone 135 is the only part which can deform because of the radial thrust of the fluid under pressure. This deformation brings the central zone 135 of the tube 133 into contact with the spout 13, and therefore allows both to open the containers 11 and to hold the corresponding lids 12.

Both the inflatable packing 33 and the tube 133 are made of elastically deformable material, which preferably supports a high number of deformation cycles, and therefore they are not affected by possible variability of the diameters of the spouts 13; they also allow to hold the lids 12 reliably, thanks to the fact that advantageously they can be made of material with a high friction factor.

The invention claimed is:

1. Device for opening, re-closing, or holding a lid of a container, the container provided with an oblong spout having a through hole for the passage of a product present in the container, comprising:

a removal head of the pneumatic type, the removal head including:

a first pneumatic circuit of fluid under pressure provided with a feed pipe and a through housing channel which develops along an axis and in which the spout is at least partly housed, said housing channel being in fluidic communication with said feed pipe for the passage of the fluid under pressure through the through hole of the spout, and a holding member, associated with the removal head, to cooperate with the spout, wherein the holding member forms a second pneumatic circuit of fluid under pressure and is provided with a blowing-in pipe different from the feed pipe of the first pneumatic circuit of fluid under pressure, and in that the holding member is actuated pneumatically by means of the fluid under pressure arriving from the blowing-in pipe of the second pneumatic circuit of fluid under pressure, to define at least a reversible condition of holding the spout inside the housing channel, wherein the holding member comprises elastically deformable means which laterally delimit said housing channel, said elastically deformable means comprising inflatable packing configured to be deformed elastically, in response to the fluid under pressure from the blowing-in pipe, to reduce the housing channel and radially engage the spout to hold the spout, and wherein the removal head comprises a closing sleeve and a centering sleeve coupled to the closing sleeve, and wherein the inflatable packing is disposed between the closing sleeve and the centering sleeve.

2. Device as in claim 1, wherein the elastically deformable means are shaped with an axial-symmetric development, centrally delimiting the housing channel and are configured to deform radially with respect to the axis toward the inside of the housing channel.

3. Device as in claim 1, wherein the centering sleeve is at the lower part of the removal head, wherein the centering sleeve is coaxial to the axis and shaped to define a lead-in zone, for the correct centered insertion of the spout inside the housing channel, wherein the lead-in zone terminates with a through hole which faces toward the housing channel.

4. Device as in claim 3, wherein the centering sleeve is shaped so as to also define a housing seating, and wherein the elastically deformable means is seated against the housing seating.

5. Device as in claim 4, wherein the closing sleeve is positioned at least partly inside the housing seating of the centering sleeve, in order to clamp the elastically deformable means and to define a compression chamber closed with a fluid-tight seal, inside the housing seating, in selective fluidic communication with the second pneumatic circuit which supplies fluid under pressure by means of a connector.

6. Device as in claim 5, wherein the connector is provided with a blowing-in channel, which puts the compression chamber in communication with said blowing-in pipe, by means of which the fluid under pressure is blown into the compression chamber.

7. Device as in claim 5, wherein the inflatable packing has a first end which rests on the bottom of the housing seating and cooperates at the lower part with the closing sleeve, a second end which cooperates at the upper part with the closing sleeve and a tubular element which connects the first end and the second end, delimiting said housing channel.

8. Device as in claim 5, wherein the elastically deformable means comprise a tubular element which laterally delimits the housing channel, at least along part of its axial development, and the closing sleeve has a tubular shell which projects inside the housing seating, externally fitted to the tubular element and having at least an eyelet, which puts the compression chamber in communication with the tubular element.

9. Device as in claim 1, wherein the inflatable packing has an annular shape that internally defines the housing channel.

10. Device as in claim 1, wherein the elastically deformable means comprise a tubular element which laterally delimits the housing channel, at least along part of its axial development.

11. Device as in claim 1, wherein the removal head further comprises a guide element disposed between and connecting the feed pipe and the closing sleeve.

12. Device for opening, re-closing, or holding a lid of a container, the container provided with an oblong spout having a through hole for the passage of a product present in the container, comprising:

a removal head of the pneumatic type, the removal head including:

a first pneumatic circuit of fluid under pressure provided with a feed pipe and a through housing channel which develops along an axis and in which the spout is at least partly housed, said housing channel being in fluidic communication with said feed pipe for the passage of the fluid under pressure through the through hole of the spout, and a holding member, associated with the removal head, to cooperate with the spout, wherein the holding member forms a second pneumatic circuit of fluid under pressure and is provided with a blowing-in pipe different from the feed pipe of the first pneumatic circuit of fluid under pressure, and in that the holding member is actuated pneumatically by means of the fluid under pressure arriving from the blowing-in pipe of the second pneumatic circuit of fluid under pressure, to define at least a reversible condition of holding the spout inside the housing channel, wherein the holding member comprises elastically deformable means which laterally delimit said housing channel, said elastically deformable means comprising inflatable packing configured to be deformed elastically, in response to the fluid under pressure from the blowing-in pipe, to reduce the housing channel and radially engage the spout to hold the spout, and wherein the removal head comprises a closing sleeve and a centering sleeve coupled to the closing sleeve, and wherein the inflatable packing has a first portion engaging the closing sleeve and a second portion engaging the centering sleeve.

13. Device as in claim 12, wherein the removal head further comprises a guide element disposed between and connecting the feed pipe and the closing sleeve.

14. Device as in claim 12, wherein the elastically deformable means are shaped with an axial-symmetric development, centrally delimiting the housing channel and are configured to deform radially with respect to the axis toward the inside of the housing channel.

15. Device as in claim 12, wherein the centering sleeve is at the lower part of the removal head, wherein the centering sleeve is coaxial to the axis and shaped to define a lead-in zone, for the correct centered insertion of the spout inside the housing channel, wherein the lead-in zone terminates with a through hole which faces toward the housing channel.

16. Device as in claim 15, wherein the centering sleeve is shaped so as to also define a housing seating, and wherein the elastically deformable means is seated against the housing seating.

17. Device as in claim 16, wherein the closing sleeve is positioned at least partly inside the housing seating of the centering sleeve, in order to clamp the elastically deformable means and to define a compression chamber closed with a fluid-tight seal, inside the housing seating, in selective fluidic communication with the second pneumatic circuit which supplies fluid under pressure by means of a connector.

18. Device as in claim 17, wherein the connector is provided with a blowing-in channel, which puts the compression chamber in communication with said blowing-in pipe, by means of which the fluid under pressure is blown into the compression chamber.

19. Device as in claim 17, wherein the elastically deformable means comprise a tubular element which laterally delimits the housing channel, at least along part of its axial development, and the closing sleeve has a tubular shell which projects inside the housing seating, externally fitted to the tubular element and having at least an eyelet, which puts the compression chamber in communication with the tubular element.

20. Device as in claim 12, wherein the elastically deformable means comprise a tubular element which laterally delimits the housing channel, at least along part of its axial development.

* * * * *